United States Patent [19]

Venkatesan et al.

[11] 4,454,018

[45] Jun. 12, 1984

[54] SIMULTANEOUS CRUSHING AND RETORTING OF OIL SHALE WITH FLUID JETS

[75] Inventors: Valadi N. Venkatesan, Dallas; Lawrence R. Stowe, Plano, both of Tex.

[73] Assignee: Mobil Oil Corporation, New York, N.Y.

[21] Appl. No.: 484,794

[22] Filed: Apr. 14, 1983

[51] Int. Cl.[3] ..... C10G 1/02

[52] U.S. Cl. ..... 208/11 R; 201/7; 201/43

[58] Field of Search ..... 208/11 R, 8 R; 241/5, 241/39; 201/7, 43

[56] References Cited

U.S. PATENT DOCUMENTS

| | | | |
|---|---|---|---|
| 2,257,907 | 10/1941 | Griswold | 241/39 |
| 2,587,609 | 3/1952 | Fisher | 241/39 |
| 2,846,150 | 8/1958 | Work | 241/39 |
| 3,614,000 | 10/1971 | Blythe | 241/5 |
| 3,960,702 | 6/1976 | Allred | 208/11 R |
| 4,012,311 | 3/1977 | Greene | 208/11 R |
| 4,132,180 | 1/1979 | Fredrick | 241/39 |

*Primary Examiner*—Delbert E. Gantz
*Assistant Examiner*—Lance Johnson
*Attorney, Agent, or Firm*—A. J. McKillop; M. G. Gilman; J. F. Powers, Jr.

[57] ABSTRACT

A method for recovering hydrocarbons from oil bearing shale which comprises placing the shale in pulverized form into a retort and simultaneously processing under retorting conditions.

19 Claims, 3 Drawing Figures

SIMULTANEOUS CRUSHING AND RETORTING OF OIL SHALE WITH FLUID JETS

BACKGROND OF THE INVENTION

Field of the Invention

The present invention relates to the field of retorting oil shale, particularly by pulverizing and simultaneously retorting with superheated water vapor.

DESCRIPTION OF THE INVENTION AND SUMMARY OF THE INVENTION

Technology for producing oily matter from kerogenous shales is very old, and for over 100 years, methods of retorting have been widely investigated. Investigations have been conducted concerning the reduction in particle size of the raw kerogenous shales for increased hydrocarbon yields. Also, investigations have been conducted regarding the use of vapor phase water (VPW) or superheated steam. Other investigations have been conducted regarding use of hot retorted shale to heat raw shale.

Allred, U.S. Pat. No. 3,960,702 teaches use of VPW for retorting oil shale and the patent is hereby incorporated by reference. Use of superheated steam or VPW as a retorting agent has also been widely advocated, for example: Wells, W. E., and Ruark, J. R., *Pilot Plant Batch Retorting of Colorado Oil Shale,* pp. 9–11, RI 4874. USBM, May 1952, showed the use of steam in the Royster retort increased the shale off-gas volume by a factor of 2, and also markedly increased the hydrogen content of the off-gas; *Synthetic Liquid Fuels,* Part II, *Oil from Oil Shale,* pp. 45–49, RI 4943, USBM, January 1953, and pp. 35–39, RI 5044 USBM, April 1954, using an entrained solids retort, reported data on the use of high-temperature steam (1000°–1500° F.) as the entraining agent; Gavin, M. J. and Desmond, J. S., *Construction and Operation of the USBM Experimental Oil-Shale Plant* 1925–1927. USBM Bulletin No. 315, reported on the U.S. Bureau of Mines Experimental oil shale plant at De Beque, Colorado, mentioning the use of steam injection in the operation of the 'Pumpherston retort' during its operation in 1925 through 1927; Peck discusses the distillation of oil shale under fluidizing conditions using steam in U.S. Pat. No. 2,449,615; Belser disclosed the use of steam as a means of in situ recovery in U.S. Pat. No. 2,725,939; Schulman, in U.S. Pat. No. 3,520,795, outlines the use of steam in a shaft kiln as a means of retorting oil shale.

It is known in the prior art to fluidize oil shale for increased hydrocarbon yields. Tsai, U.S. Pat. No. 4,166,022 teaches the importance of particle size, and this patent is also incorporated by reference. Tsai taught pulverizing oil shale to a size not greater than ½ inch. For example, the shale can have a mesh size of about 4, but not in excess of about 200 using a U.S. standard sieve, preferably at least about 6 but not in excess of about 20.

In the prior art it is also known to withdraw hot retorted or spent shale from a combustion zone and recycle a portion of the hot spent shale into a retorting zone. Clark et al disclosed this in U.S. Pat. No. 2,474,345. This patent is hereby incorporated by reference. As practiced by Clark et al, separate vessels were used to conduct the retorting of raw shale and the combusting of spent shale.

Until now a method did not exist for the VPW retorting and simultaneous pulverizing of oil shale. As will be shown in the embodiments, applicants' invention affords for a reduction in the amount of equipment necessary to retort raw oil shale. Since the VPW retorting and simultaneous pulverizing occur in the same zone, greater energy efficiencies are obtained leading to a reduction in heating and operating costs. Additionally, dust pollution problems are minimized while greater control can be maintained over operating temperatures and conditions.

In accordance with one embodiment of the present invention crushed raw oil shale is fed into the lower portion of an apparatus where opposing streams of VPW cause the shale particles to forcibly impact on each other while simultaneously being heated to retort temperatures. Forcibly impacted shale particles are transferred by the VPW into an upper comminution zone along with the hydrocarbon products. Fine retorted fluidized oil shale particles, along with the hydrocarbon products, exit the apparatus for separation while the coarser oil shale particles fall down by gravity into two opposing legs. Here the coarse particles are drawn into the VPW stream and forceably impacted upon each other via VPW from two opposing fluid jets.

Applicant's invention provides for a process which comprises feeding crushed oil shale into a VPW retorting and simultaneously pulverizing zone, retorting by VPW and simultaneously pulverizing crushed oil shale, removing the spent oil shale and hydrocarbon products from the retorting and simultaneous pulverizing zone, separating the spent shale from the hydrocarbon products, collecting the hydrocarbon products and disposing of the spent oil shale ash.

A general object of the present invention is to provide an efficient process for VPW retorting and simultaneous pulverizing of crushed raw oil shale particles which affords better retort temperature control and greater operating flexibility.

Another object of the present invention is to provide a method for continually pulverizing and simultaneously retorting oil shale to maximize production of hydrocarbon products and minimize process heat loss.

Yet another object of the present invention is to minimize spent oil shale dust pollution while pulverizing oil shale into a fluidized state.

Other objects will become apparent as the embodiments are set forth.

DESCRIPTION OF THE DRAWINGS

Particular embodiments of the present invention are illustrated in the accompanying drawings wherein.

DESCRIPTION OF THE PREFERRED EMBODIMENTS

Figure 1:
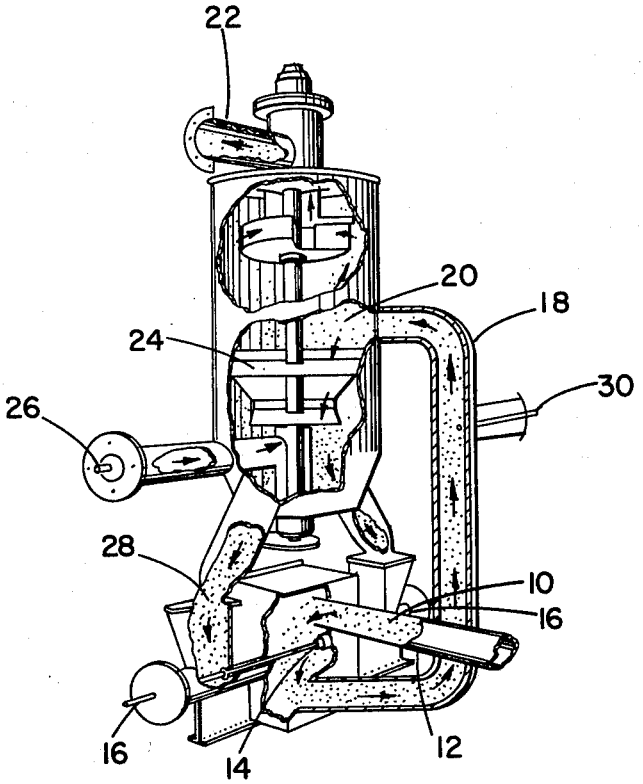
FIG. 1 is a perspective and sectional view of an apparatus for the VPW retorting and simultaneous pulverizing of oil shale particles embodying features of the present invention.

FIG. 1 shows an apparatus which comprises one embodiment of the invention. This apparatus is generally termed a "fluid-energy mill" or a "jet-mill". One such apparatus which embodies many of the features desired is the Majac jet pulverizer, and it is hereby incorporated by reference. Via line (12) crushed oil shale of a particle size of from about ½" to about 2" is fed into the bottom portion of the jet-mill. Here these oil shale particles are forcibly impacted upon one another by two opposing fluid streams of superheated steam of VPW which enter through lines (16). When the particles directed by the two opposing streams from lines (16) come into contact with each other, upon impact they are shattered and pulverized into smaller particle sizes. While being pulverized, the particles are simultaneously heated to retorting temperatures by the superheated steam or VPW. After impact the retorted coke particles are removed from the retorting zone (14) and are transported by the superheated steam or VPW via line (18) into an upper zone (20). In this zone (20) the heavier particles are caused to fall down through a separating and communition plate (24). Size of the particles which fall down through the communition plate (24) is dependent upon gravity and the velocity of the VPW. After falling through the communition plate (24), in one embodiment of the invention, superheated steam or VPW is admitted through line (26) where it contacts the partially retorted large particles and causes additional stripping of hydrocarbon products to be stripped and emitted therefrom. Hydrocarbon vapors from this contact arise through the communition plate (24) and exit the apparatus through line (22). The smaller particles with coke deposited thereon and hydrocarbon products from line (18) which proceed into the upper zone (20) also exit via conduit (22). Conduit (22) directs the resultant mixture away from the apparatus for further processing.

Larger particles which have passed through the communition plate (24) and which have been contacted with superheated steam (26) or VPW from line (26) fall down via gravity into two opposing legs (28) of the aparatus where they are forcibly ejected into the simultaneous pulverizing and retorting zone (14) by superheated steam or VPW from line (16) and recycled. This process of retorting, simultaneously pulverizing, and recycling the retorted particles and removing the hydrocarbon products is continued until substantially all the hydrocarbon products are removed therefrom which will generally be when the particle sizes of the retorted shale reach a size of from about 44–50 microns, or about 200 mesh. Pressures in the retorting and simultaneous pulverizing zone (14) will be about 2 to about 150 psig. Temperatures in zone (14) will preferably be in the range of from about 425° C. to about 550° C. and most preferably from about 450° C. to about 500° C. This temperature range is especially important in conserving thermal dynamic values, in maximizing recovery of the organic values, and in providing a solid disposable waste. The superficial gas velocities will preferably be in the range of from about 20 to about 1000 feet per minute. The time of contact while not narrowly critical should be in the range of from about 0.01 to about 90 minutes. Of course the optimum contact time will vary somewhat according to the particle size of the oil shale which is admitted into the retorting and simultaneous pulverizing zone (14) via line (12). Larger particle sizes will require a longer contact time to be thoroughly penetrated by heat and water vapor.

In another embodiment of this invention carbon dioxide at a temperature of from about 450° C. to 500° C. is used for the retorting and simultaneous pulverizing. Superheated carbon dioxide is injected into the jet-mill (33) by at least two opposing fluid jets (16). Supercritical carbon dioxide can also be used for the retorting and simultaneous pulverizing. Use of supercritical carbon dioxide and other extracts which can be utilized appear in U.S. Pat. No. 4,108,760, which is hereby incorporated by reference in its entirety.

Other extractant gases can be used for simultaneous retorting and pulverizing when the extractant is above its critical pressure and the temperature is within the range of about 350° C. to 550° C. Extractant gases which can be utilized for this purpose, can be selected from a group comprising ethylene, carbon dioxide, alcohol, aldehyde, ketone, ether, and ester. Aromatic hydrocarbons having a single benzene ring substituent group can be utilized. Alicyclic hydrocarbons having at least 5 carbon atoms and not more than 12 carbon atoms can be utilized. Aromatic hydrocarbons having 2 aromatic rings can also be utilized. It is also possible to utilize aliphatic hydrocarbons having at least 5 carbon atoms and not more than 16 carbon atoms. Phenol derived from an aromatic hydrocarbon having up to 8 carbon atoms also can be utilized. The utilizable group also includes aliphatic mono, di- and tri-amines having at least 4 and not more than 10 carbon atoms. Acyclic aliphatic amines can be utilized as well. Additionally, aromatic amines having a benzene ring in the absence of externally supplied hydrogen can be used to extract extractable constituents from the oil shale. Collectively, these extractant gases will be designed supercritical gases.

In another embodiment of the invention air is injected into the jet-mill via line (26). This air contacts the hot coke covered partially retorted shale which has fallen through the communition plate (24). Upon contacting the air the large particles of coke covered partially retorted shale ("hot solids"), combustion occurs. This causes additional heat to be imparted to the hot solids. These hot solids fall down into opposing legs (28) where they are forced into the simultaneous retorting and pulverizing zone (14) via fluids entering through lines (16). In yet another embodiment, in lieu of superheated steam, high pressure water can be emitted through lines (16). When this high pressure water contacts the hot solids which serve as a heat carrier, steam is generated in situ for simultaneous retorting and pulverizing purposes. Once recycling of the partially retorted shale occurs, the partially retorted shale will be hot enough to serve as a heat carrier even when air is not injected via line (26). One obvious benefit of this embodiment is that process heat requirements are greatly minimized.

In yet another embodiment of this invention, steam is ejected into the apparatus via line (30). When the steam from line (30) contacts the partially retorted shale in line (18) additional stripping of hydrocarbon product occur. Additionally, steam emitted from line (30) can be used to maintain operating temperature requirements.

Figures 2, 3:
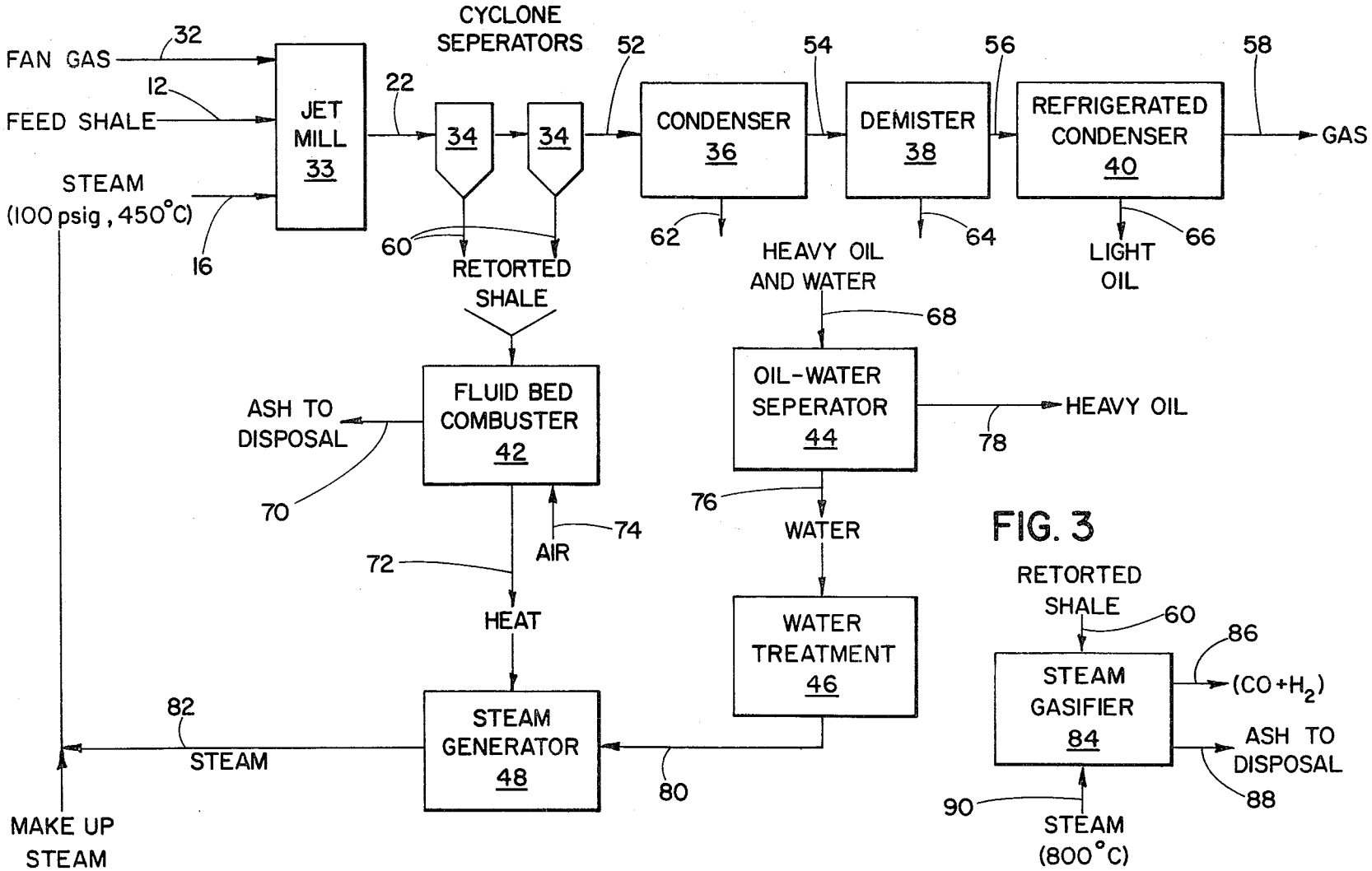
FIG. 2 represents a schematic diagram of the process steps utilized in one embodiment of the present invention.
FIG. 3 is a schematic diagram of a steam gasifier which can be utilized in another embodiment of the present invention.

FIG. 2 which is a block diagram of the entire oil shale retorting process shows the jet-mill (33) in the preferred embodiment of the invention.

After exiting the jet-mill (33) the fine particles of coke covered retorted shale along with the hydrocarbon products are led via line (22) to the cyclone separators (34). Here the cyclone separators (34) cause a separation of the hydrocarbon products from the retorted fine shale particles which are collected via line (60) and led into a fluid bed combustor (42). The retorted shale coated with coke is then contacted with air which enters the fluid bed combustor (42) via line (74). Fluid bed combustor temperatures are maintained at a temperature of from about 550° C. to 600° C. After contact with the heated air the coke covered retorted shale forms a process gas comprising carbon monoxide. As a result of this combustion process, the process gas obtains an even hotter temperature. With the temperatures being maintained so highly, the process gas absorbs heat and is removed from the fluid bed combustor (42) via line (72). After removal from the fluid bed combustor (42), the hot retorted shale ("hot solids") are contacted with water to form steam in the steam generator (48). This steam exits the steam generator by line (82) and goes to the jet-mill (33). Hot solids exit the steam generator by line (75). Line (82) transfers the steam along with any necessary makeup steam which may be required to maintain the steam or VPW at a temperature of about 450° C. into the two opposing fluid jets (16) where it is used for further retorting and simultaneous pulverizing in jet-mill (33).

Hydrocarbon products from the cyclone separators (34) are taken via line (52) into a condenser (36). In the condenser (36) the hydrocarbon products are cooled. After cooling, the heavy oil and water are removed from the condenser (36) via line (62). Gaseous lighter hydrocarbon products are removed from the condenser (36) via line (54) and are injected into a demister (38). In the demister (38), moisture is removed from the remaining hydrocarbon products. Heavy oil and water fall to the bottom of the demister (38) and are withdrawn via line (64). Thereafter, the heavy oil and water are fed into an oil-water separator (44) via line (68). The oil-water separator (44) causes the heavy oil to be separated from the water. After separation from the water, the heavy oil is removed via line (78). Water is removed from the oil-water separator (44) via line (76). This water is chemically treated in vessel (46) and is removed from the water treatment vessel (46) via line (80) where it is used to generate steam in the steam generator (48). Lighter gaseous hydrocarbon products are removed from the demister (38) via line (56) where they are inducted into a refrigerated condenser (40). Here the light oil is removed from the hydrocarbon products after chilling and is led from the refrigerator condenser (40) via line (66) where the light oil is further processed. Gas from the refrigerated condenser (40) is removed via line (58). This gas can be used as a heat source to generate additional steam in the process.

In another embodiment of the invention the fluid bed combustor (42) is replaced by a steam gasifier (84) which is detailed in FIG. 3. Here the retorted shale coated with coke is led into the steam gasifier via line (60) where it is contacted with superheated steam or VPW and is led into the steam gasifier via line (90). The temperature in the steam gasifier (84) is maintained at a temperature of from about 800° to about 1000° C. Line (86) removes the high BTU synthesis gas from the steam gasifier (84). This synthesis gas comprises carbon monoxide and hydrogen. Spent shale is removed from the steam gasifier via line (88) and is sent to a disposal unit.

To those skilled in the art to which this invention pertains, many modifications and adaptations thereof will suggest themselves. Accordingly, it should be understood that the specific disclosures and descriptions contained herein are to be taken in an illustrative sense and that the scope of the invention is not to be limited thereby except in accordance with the accompanying claims.

What is claimed is:

1. A process for recovery of hydrocarbon products from oil bearing shale, including simultaneous retorting and pulverizing of the oil shale, comprising:
   (a) feeding crushed oil shale into a retorting and pulverizing zone;
   (b) simultaneously retorting and pulverizing the shale of step (a) with fluids heated to a temperature suitable for retorting from at least two opposed fluid jets to pulverize the shale and release hydrocarbon products;
   (c) transporting the shale, hydrocarbon products and fluids of step (b) away from the retorting and pulverizing zone to a separating zone above said retorting and pulverizing zone;
   (d) in the separating zone, separating the hydrocarbon products and shale particles which have been pulverized to a size so that substantially all hydrocarbon products have been removed therefrom, from larger, partially retorted shale particles;
   (e) contacting the larger particles of step (d) with a combustion or stripping fluid emitted from at least one fluid jet located above said retorting and pulverizing zone and recycling the larger particles to the retorting and pulverizing zone after the contacting; and
   (f) collecting the hydrocarbon products.

2. A process as in claim 1 where in step (e) the fluid is air for combustion and in step (b) high pressure water provides the fluid for retorting and simultaneously pulverizing oil shale after the oil shale has been initially retorted and recycled causing steam to be generated in situ.

3. A process as in claim 2, wherein the recycled particles of step (e) are recycled to the fluid jets of the retorting and pulverizing zone and are injected into the retorting and pulverizing zone with the heated fluids, and the crushed oil shale of step (a) is fed into the retorting and pulverizing zone by being dropped between the opposed fluid jets.

4. A process as in claim 1 where in step (b) the retorting and simultaneous pulverizing are accomplished by use of supercritical fluids of a temperature from about 350° to about 550° C.

5. A process as in claim 1 where in step (b) carbon dioxide at its supercritical pressure and temperature provides the fluid for retorting and simultaneously pulverizing oil shale.

6. A process as in claim 1 where in step (b) the heated fluid comprises steam and is of a temperature of from about 450° C. to about 500° C.

7. A process as in claim 1 where in step (e) the retorted pulverized shale is contacted with air for combustion from at least one fluid jet prior to being recycled into the simultaneous retorting and pulverizing zone.

8. A process as in claim 1 where in step (e) the retorted pulverized shale is contacted with steam for stripping hydrocarbons from at least one fluid jet prior to being recycled into the simultaneous retorting and pulverizing zone.

9. A process as in claim 1 where in step (c) the retorted pulverized shale is contacted with steam for stripping hydrocarbons after leaving the retorting and simultaneous pulverizing zone and before reaching the separating zone.

10. In a process for recovering hydrocarbon products from oil bearing shale by retorting the shale which includes feeding crushed oil shale in a retort under oil shale retorting conditions, separating and recovering the resultant oil products, the improvement which comprises:

(a) simultaneously retorting and pulverizing the shale with fluids heated to a temperature suitable for retorting from at least two opposed fluid jets to pulverize the shale and release hydrocarbon products;

(b) transporting the shale, hydrocarbon products and fluids of step (a) away from the retorting and pulverizing zone to a separating zone above said retorting and pulverizing zone;

(c) in the separating zone, separating the hydrocarbon products and shale particles which have been pulverized to a size so that substantially all hydrocarbon products have been removed therefrom, from larger, partially retorted shale particles; and (d) contacting the larger particles of step (c) with a combustion or stripping fluid emitted from at least one fluid jet located above said retorting and pulverizing zone and recycling the larger particles to the retorting and pulverizing zone after the contacting.

11. A process as in claim 10 where in step (a) the retorting and simultaneous pulverizing are accomplished by use of supercritical fluids of a temperature from about 350° to about 550° C.

12. A process as in claim 10 where in step (c) the shale separated with the hydrocarbon product has been pulverized into a particle size no larger than about 44 to 50 microns.

13. A process as in claim 10 where in step (d) the fluid is air for combustion and in step (a) high pressure water is the fluid used for retorting and simultaneously pulverizing oil shale after the oil shale has been initially retorted and recycled causing steam to be generated in situ.

14. A process as in claim 10 where in step (a) supercritical fluids are used for retorting and simultaneously pulverizing oil shale.

15. A process as in claim 10 where in step (a) superheated steam is used for retorting and simultaneously pulverizing oil shale.

16. A process as in claim 10 where in step (a) carbon dioxide at its supercritical pressure and temperature is used for retorting and simultaneously pulverizing oil shale.

17. A process as in claim 10 where in step (b) steam from at least one fluid jet for stripping hydrocarbons is injected after removing the retorted shale, fluids and hydrocarbon products from the retorting and simultaneous pulverizing zone and before reaching the separating zone.

18. A process as in claim 10 where in step (d) air for combustion is the fluid emitted from at least one fluid jet.

19. A process as in claim 10 where in step (d) vapor phase water for stripping is the fluid emitted from at least one fluid jet.

* * * * *